United States Patent [19]

Bard

[11] Patent Number: 4,847,931

[45] Date of Patent: Jul. 18, 1989

[54] WATER PILLOW

[76] Inventor: Maurice R. Bard, 38 Hirondelle Pl., Don Mills, Ontario, Canada, M3A 1V8

[21] Appl. No.: 192,783

[22] Filed: May 10, 1988

[51] Int. Cl.[4] ..... A47G 9/00; A47C 27/08

[52] U.S. Cl. ..... 5/441; 5/450; 5/451

[58] Field of Search ..... 5/441, 451, 452, 462, 5/422, 450

[56] References Cited

U.S. PATENT DOCUMENTS

| | | | |
|---|---|---|---|
| 587,224 | 7/1897 | McKelvey | 5/454 |
| 2,521,530 | 9/1950 | McGuffage | 5/441 |
| 3,411,164 | 11/1968 | Sumergrade | 5/441 |
| 3,702,484 | 11/1972 | Tobinick et al. | 5/451 |
| 3,766,579 | 10/1973 | Shields . | |
| 3,802,004 | 4/1974 | Whitney . | |
| 4,301,560 | 11/1981 | Fraige . | |
| 4,330,893 | 5/1982 | Matsui . | |
| 4,370,769 | 2/1983 | Herzig et al. . | |
| 4,399,575 | 8/1983 | Hall . | |
| 4,638,518 | 1/1987 | Barbulla . | |

OTHER PUBLICATIONS

"Liberty" An Ad on Page 87 of the Flotation Sleep Industry Magazine, Jun. 1982 Issue.

*Primary Examiner*—Alexander Grosz

[57] ABSTRACT

The present invention relates to a pillow having a thin envelope layer adjacent a bottom surface isolated from the top surface of the pillow by compressible filler material. It has been found that this thin envelope layer filled with a suitable fluid with the compressible filler thereabove greatly improves the comfort of the pillow and the size of the envelope can be reduced. By so positioning the envelope, the range of deformation and orientation of the envelope is reduced.

17 Claims, 1 Drawing Sheet

WATER PILLOW

This application is related to United States Application Ser. No. 845,898 now abandoned.

FIELD OF THE INVENTION

The present invention relates to water filled pillows and particularly, pillows having a water envelope preferably for use on a flat surface such as a bed, cot or the like. In particular, the invention relates to a pillow having an envelope layer adjacent the bottom surface thereof separated from the top surface by a compressible filler material.

Various seat supports have been proposed which make use of a fluid envelope where the fluid is displaced or partially displaced as a person sits upon the pillow. It is also known to combine the water envelope with an outer envelope, which preferably has compressed air, where this outer area acts as a border and protects against leakage should puncture occur to the inner envelope.

Other pillow arrangements are known where the water envelope is placed centrally within a pillow with a compressible layer top and bottom thereabout. This symmetrical arrangement provides the water envelope with a greater range of deformation and uncertainty with respect to the in use configuration of the water envelope.

The following references show various prior art structures:

U.S. Pats. Nos. 2,822,544, 3,251,075, 2,612,645, 2,691,179, 2,748,399, 3,702,484, 3,736,604, 4,292,702, 4,389,742, 2,942,281, 3,983,587, 3,251,075, 3,722,012, 4,247,963, 4,656,681.

SUMMARY OF THE INVENTION

According to the present invention, a pillow comprises a top surface, a bottom surface and a compressible filler therebetween with a thin envelope layer intermediate the pillow and adjacent the bottom surface offset from the center plane running between the top and bottom surfaces. The envelope layer is adapted to sealably receive a fluidlike material therein and the compressible filler serves to isolate the thin envelope from the top surface.

According to an aspect of the invention, the envelope is disposed at an angle to slope from front to back within the pillow such that the envelope adjacent the front of the pillow is elevated. By so disposing the envelope, initial compression of the bed and the pillow brings the envelope to a more or less horizontal position and as such, the envelope initially moves towards a horizontal position during compression, rather than merely move away from the horizontal position if the envelope was not so disposed.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
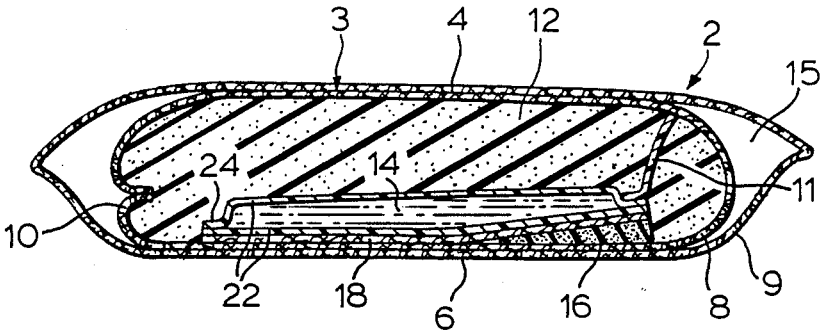
FIG. 1 is a sectional view through the pillow.
Figure 2:
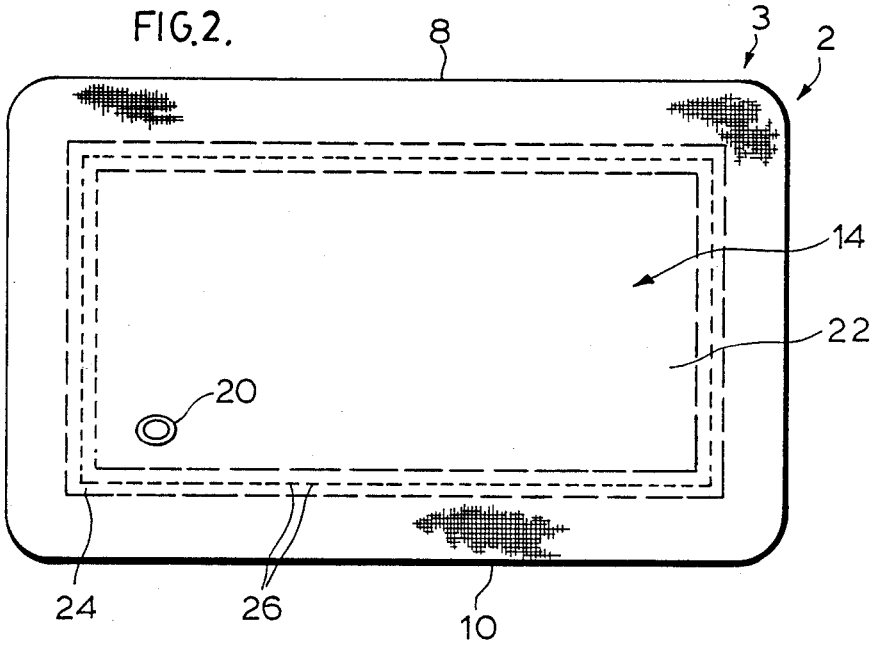
FIG. 2 is a bottom view showing the envelope in dotted lines.

The pillow 2 shown in the drawings has a casing 3 having a top surface 4, a bottom surface 6, a front surface 8 and a back surface 10. A compressible filler material 12 is shown and serves to separate the thin envelope 14 adapted to retain a fluid from the top surface 4. The compressible filler may be any suitable material such as chipped foam, solid foam, feathers, loose fiberfill or the like, which provide resiliency and comfort in supporting the head of a user. About the pillow 2 is a pillow casing 9.

The envelope 14 is offset and below a center plane running horizontal through the pillow and is separated from the bottom surface 6 of the pillow 2 by a foam wedge member 16 which predisposes the envelope 14 to slope from front to back and, in effect, raises the front portion of the envelope. This can be clearly seen in FIG. 1 and during use the foam compressive member 16 will compress due to the weight of the user such that the envelope will approach a generally horizontal orientation beneath the user's head. The wedge also serves to reduce the effect of displacement of the bed mattress on envelope 14 due to the weight of the user supported adjacent the pillow. The wedge member 16 is preferably of a maximum thickness of about one-half of an inch.

By positioning the envelope 14 at the bottom surface and thus essentially directly supported by a bed, the water within the envelope remote the portion directly supporting the head of the user is not at a substantially elevated position where it would create a pressure due to the weight of the water. This pressure would tend to raise the head of the user and result in increased water movement with head movement and possible head discomfort.

Separating the thin envelope 14 from the bottom surface 6 is a thermal reflector 18. This thermal reflector 18 reduces heat transfer between bottom surface 6 and the envelope 14. Thus, if a user places their arm beneath the pillow, the amount of heat transfer between the arm and the envelope 14 is reduced. Compressible filler 12 reduces heat transfer between the head of the user and the envelope 14. Preferably, the compressible filler is about 3½ to 4 inches thick.

A reclosable inlet 20 is provided through which a fluid can be introduced to the envelope. The inlet 20 is provided adjacent the bottom surface, making access convenient and isolating the inlet from any position which would render the pillow less usable. The position of the envelope, adjacent the bottom surface, allows the spout of the inlet to be much shallower and thus reduces the effect of the same on the envelope. The envelope, itself, has opposed film 22 of ethylene vinyl acetate or the like heat sealed adjacent the perimeter. A flange area 24 is provided beyond the heat seal which serves as a means by which the envelope can be attached to the thermal reflector 18 and any other components. This is illustrated in the drawing by stitches 26 shown securing the sheets to the thermal reflector. The remaining components can be attached to the envelope whereby the casing 3, in effect, provides sheets defining the top surface, bottom surface, front surface and back surface and, interior thereto, the thin envelope 14 and thermal reflector sheet 18. Once the pillow casing, including the envelope, has been made, the compressible filler 12 can be inserted. The wedge member is added at the time the casing is stitched.

To assure that compressible fill material is provided adjacent the front surface 8, a partition 11 has been provided which defines a pocket 15 at the front of the pillow which serves to retain filler in this location.

The material of the envelope is preferably an ethylene vinyl acetate having about 12% vinyl acetate. This material is quite pliable and noiseless with deformation of the pillow.

It has been found that by providing a thin envelope adjacent the bottom surface of the pillow and below the center line of the pillow when the pillow is in its operating orientation, the compressible filler material is supported on a layer of displaceable water, the volume of which is relatively low. Thus, with a preferably thickness of only about one-half inch to an inch of water, the resilient feeling of a waterbed is achieved without the large quantity or mass of water. The natural feel of a pillow is at least partially maintained as it can have a similar compressible filler material, with this pillow enhanced due to the fluid characteristics introduced by the fluid maintained within the thin envelope 14. The large thickness of compressible filler material above the envelope distributes the load of a user's head to a larger area, which assists in reducing the thickness of water required. In the preferred embodiment, the envelope 14 does not extend to the perimeter of the pillow, thus further reducing the quantity of water.

By positioning the envelope adjacent the bottom surface 6 of the pillow, the orientation of the thin envelope 14 is determined and it will be generally supported along a flat planar type surface of a bed or cot. This location of the envelope renders it less susceptible to extreme deformations possible if the envelope has generally centrally disposed. Thus, by positioning the envelope can be reduced whereby the characteristics of a water filled envelope are imparted to the pillow without a significant amount of water. Furthermore, the pillow is much more consistent as the orientation is assured and additional features, such as predisposing the envelope at an upward angle and having a greater thickness of filler material above the envelope, are practical as the range of deformation is reduced.

The user will add the fluid to the thin envelope 14 and can vary the fill quantity if desired to achieve different characteristics. The inlet 20 to the envelope 14 is provided on the bottom surface and is accessible through the pillow. This is a reclosable inlet and, thus, the pillow may be adjusted as required by the user. Obviously for the intended purpose of the pillow. Water is certainly adequate, although some gel type materials may also be useful.

The envelope 14 does not require any baffling arrangement, as the size of the envelope is reduced and the displacement of water has been accommodated. This greatly simplifies manufacture and consistency of the pillow. The envelope 14 shown need not extend to the perimeter of the pillow and a border area of 2 to 3 inches has proven acceptable. This reduced envelope size again reduces the fill quantity and weight of the pillow while still providing the improved characteristics. This probably occurs as the head of a user is supported over a fairly large area of the pillow and, thus, the envelope will be deformed and effect the compression of the pillow even if the user's head is positioned and supported at the pillow edge.

The pillow casing 3, prior to being stuffed, is preferably about 20 by 26 inches and the envelope is centrally disposed and of a size of about 12 by 19 inches. The fill quantity of the envelope can vary according to the user's requirements, however, it is preferably about 80 fluid ounces. The thickness of film 22 are preferably about 3 to 5 mils.

It has been found that this pillow accommodates shifting in the head position to provide full support along the entire surface of the head in contact with the pillow and obviously will provide more uniform support than a conventional pillow. In addition, the movement of the pillow provides a massaging effect; a feature not found in conventional pillows. The positioning of the envelope is important to the present invention, as a positioning, for example, in the center line of the pillow does not achieve the advantages. Similarly, the presence of the foam wedge member accommodates depression and orientation of the envelope for its intended use. The portion of the envelope beyond the head essentially acts as a reservoir and accommodates changing placements of the head on the pillow.

In most cases, the thermal reflector 18 is only required at the bottom of the envelope as the fill material above envelope 14 inherently acts as a good insulator. This thermal reflector can be wrapped about the envelope if desired to further insulate the top surface of the pillow from the envelope. The reflector is best separated from the top surface by the compressible filler material.

In addition to the improved operating conditions described above, this particular placement of the envelope 14 simplifies manufacture of the pillow as the envelope can be directly secured to the casing and the thermal reflector. This securement also limits the configuration of the envelope as it is mechanically fastened to the casing.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A pillow comprising a top surface, a flexible bottom surface and a compressible filler therebetween, said pillow further including a thin envelope layer intermediate to said surfaces and positioned adjacent said bottom surface below a center plane running between said surfaces, said envelope layer being adapted to sealably receive a fluid-like material therein isolated from said top surface by said compressible filler, said envelope being secured within said pillow to maintain a position overlying said bottom surface, the uncompressed volume of said compressible filler being at least several times greater than the in use volume of said envelope, said pillow being readily deformable when a load is applied to said top or bottom surface.

2. A pillow as claimed in claim 1 wherein said envelope is sloped across the pillow front to back with the envelope adjacent the front being elevated.

3. A pillow as claimed in claim 2 wherein said envelope is spaced from said bottom surface by a foam member which serves to dispose said envelope at said slope and wherein said envelope is secured about the periphery thereof to a bottom surface of the pillow.

4. A pillow as claimed in claim 3 wherein said foam member is wedge shaped.

5. A pillow as claimed in claim 1 wherein said envelope is additionally separated from a front edge of said pillow by compressible filler material maintained in a separate pocket within said pillow at said front edge to avoid rearward displacement of the material.

6. A pillow as claimed in claim 1 wherein said envelope is separated from said bottom surface by a thermal reflecting material to partially isolate the envelope.

7. A pillow as claimed in claim 1 wherein said envelope adjacent said bottom surface includes an accessible closable inlet through which water or other flowable fluid can be introduced into said envelope whereafter said inlet is closed.

8. A pillow as claimed in claim 1 wherein said envelope is attached to said bottom surface generally about the perimeter of said envelope.

9. A pillow as claimed in claim 1 wherein said envelope is partially filled with water such that localized depression causes a portion of the water in the region of the localized depression to be displaced.

10. A pillow comprising a flexible top surface and a flexible bottom support surface and at least several inches of compresible fiber fill material captured therebetween, both top and bottom surfaces being of a fabric material, a liquid retaining envelope positioned adjacent said bottom surface and secured relative to said bottom surface to maintain a thin profile when said bottom surface is generally flat, said liquid retaining envelope being positioned below a center plane passing between said bottom surface and said top surface, said envelope being thin and only partially filled such that in a horizontal position the envelope would have an average depth of less than about half of an inch to an inch, said envelope being spaced from said top surface by said fiber fill which acts as an insulator reducing heat transfer between said top surface and said envelope, said pillow being readily deformable from all surfaces when said bottom surface is generally horizontal.

11. A pillow as claimed in claim 10 wherein said envelope is of a plastic material having a heat fused seal adjacent the periphery thereof and a securing flange beyond said seal, said flange being physically attached to said bottom surface to urge said envelope to maintain a thin profile when said pillow is supported on the bottom surface in a horizontal orientation.

12. A pillow as claimed in claim 11 wherein said flange is secured by stitching to said bottom surface.

13. A pillow as claimed in claim 12 wherein said envelope includes a reclosable inlet accessible through a port provided in said bottom surface whereby the amount of fluid within said envelope may be varied by the user to modify the properties of the pillow in accordance with the user's requirements.

14. A pillow as claimed in claim 13 wherein said envelope is slightly spaced from said bottom surface and normally disposed at an angle such that the forward edge of the envelope is elevated.

15. A pillow as claimed in claim 10 including means at the front of the pillow for maintaining a pocket of fill material at the front of said pillow.

16. A pillow as claimed in claim 15 wherein said means at the front of the pillow is a separate partition secured to the pillow casing.

17. A pillow comprising a thin fluid retaining envelope at a bottom, flexible surface of the pillow, about 3 to 4 inches of a suitable compressible filler material above said envelope and in front thereof, said envelope and said filler all being retained in position due to securement with or confinement by a pillow casing, said compressible filler material being essentially supported on a displaceable liquid layer within said envelope having an average depth of less than about one inch, said compressible filler material providing a compressible means for distributing the load to said envelope and increase the area of support of the envelope when a load is applied to the top of said pillow when said pillow is supported on a generally horizontal bed surface, said envelope including securing means attached to said pillow to maintain a thin profile of said envelope above and adjacent said bottom surface, below a center plane running between the top and bottom surfaces of the pillow.

* * * * *